United States Patent [19]

Otter et al.

[11] Patent Number: 4,718,657

[45] Date of Patent: Jan. 12, 1988

[54] PAPER STACKER

[75] Inventors: Brian Otter, Toronto; Manuel Dias, Mississauga, both of Canada

[73] Assignee: Delphax Systems, Mississauga, Canada

[21] Appl. No.: 675,912

[22] Filed: Nov. 28, 1984

[30] Foreign Application Priority Data

Dec. 1, 1983 [CA] Canada ..... 442377

[51] Int. Cl.[4] ..... B65H 31/10

[52] U.S. Cl. ..... 271/184; 271/215; 271/217; 271/286

[58] Field of Search ..... 271/285, 286, 299, 306, 271/184, 207, 215, 217; 270/58; 414/62, 54, 59

[56] References Cited

U.S. PATENT DOCUMENTS

| | | | |
|---|---|---|---|
| 1,928,923 | 10/1933 | Andersen | 271/219 |
| 3,647,045 | 3/1972 | Wegener | 271/207 |
| 4,017,066 | 4/1977 | Lasher | 414/59 |
| 4,318,539 | 3/1982 | Lamos | 271/217 X |
| 4,396,334 | 8/1983 | Byrt | 271/217 X |

*Primary Examiner*—Richard A. Schacher
*Attorney, Agent, or Firm*—Rogers & Scott

[57] ABSTRACT

The invention provides a sheet stacker for receiving paper from a printer, copier and the like. The stacker includes a base, and an elevator mechanism contained in the base. A hopper sits on the base and includes a floor moveable within the hopper and supported by the elevator mechanism. As paper enters the hopper a sensor is used in conjunction with an activator to maintain the floor of the hopper at a level to ensure that each sheet slides essentially horizontally onto the stack to avoid curling of the sheet on the stack. The stacker also includes a paper positioning device above the stacker and operable by a controller to engage selected sheets as they enter the stacker. This engagement deflects the sheets to one side so that these sheets are staggered with respect to the other sheets in the pile for ease of identification in the finished pile.

11 Claims, 7 Drawing Figures

PAPER STACKER

This invention relates to paper stackers of the type used to receive paper sheets from a printer, copier or the like.

Sheet printers and copiers are now available which handle sheets remotely and at high speed. It has become necessary to provide a stacker at the output of these machines which receives the sheets and controls them to place them in a stack without folding or creasing. The main problem of such control is that the sheets often acquire an electrostatic charge and a curl caused by a combination of heat and passing the sheet around a drum or roller. If the sheet simply falls into a bin, it will tend to curl and interfere with the free fall of the next sheet and so on. It is therefore desireable to move each sheet smoothly onto the top of the stack while guiding the sheet to avoid the effects of curl and electrostatic charge.

Also, it is sometimes desirable to differentiate between groups of paper in the stack. This has been done in the past by providing a series of bins and then directing groups of sheets into each bin, a process known as "collating". It is desirable in some uses to segregate papers in a stack without the complexity of multiple bins.

Accordingly, in one of its aspects, the invention provides a sheet stacker for receiving paper from a printer, copier and the like. The stacker includes a base, and an elevator mechanism contained in the base. A hopper sits on the base and includes a floor moveable within the hopper and supported by the elevator mechanism. As paper enters the hopper a sensor is used in conjunction with activator means to maintain the floor of the hopper at a level to ensure that each sheet slides essentially horizontally onto the stack to avoid curling of the sheet on the stack.

According to another aspect of the invention, the stacker also includes a paper positioning device above the stacker and operable by the control means to engage selected sheets as they enter the stacker. This engagement deflects the sheets to one side so that these sheets are staggered with respect to the other sheets in the pile for ease of identification in the finished pile.

According to yet another aspect of the invention, the paper positioning device is reversable to deflect other selected sheets to the other side of the stacker to better define the stagger between the groups of sheets in the stack.

These and other aspects of the invention will be better understood with reference to the following description taken in combination with the drawings, in which.

Figure 1:
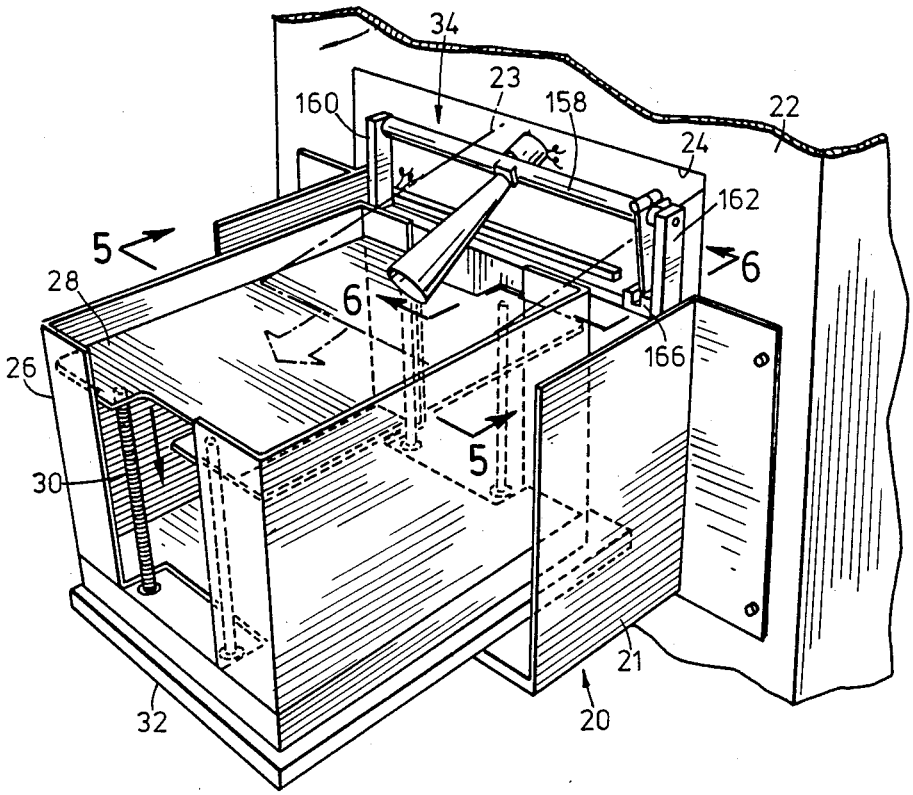
FIG. 1 is a perspective view of a preferred embodiment of a paper stacker attached to an output portion of an exemplary printer and shown in the loading position ready to receive sheets of paper from the printer.

Reference is made first to FIG. 1 which illustrates a preferred embodiment of a stacker designated generally by the numeral 20 and having a support structure 21 by which it is attached to a wall 22 of an exemplary printer or other device from which the stacker collects sheets of paper (such as sheet 23 shown in ghost outline). Paper leaves the printer through an outlet opening 24 in wall 22 driven with sufficient speed in a generally horizontal direction to fall into a hopper 26 lying in a stack of paper which develops on a moveable floor 28 carried by four supports 30 of an elevator mechanism contained in a base 32 of the stacker. The supports are tightly-wound coil springs which are stored horizontally in the base and pass about bends where they change to vertical.

The stacker 20 also includes a paper guide mechanism designated generally by the numeral 34 for use in deflecting paper sheets sideways as they move onto the stack so that the sheets can be staggered relative to one another for ease of sorting as will be described.

As will be described, when the sheets of paper build up on the moveable floor 28 of the hopper, a point is reached at which this is sensed and the elevator mechanism actuated to withdraw the supports 30 so that the floor drops and more room is made at the top of the stack for further sheets. All of this will become evident with reference to subsequent drawings and description.

Figure 2:
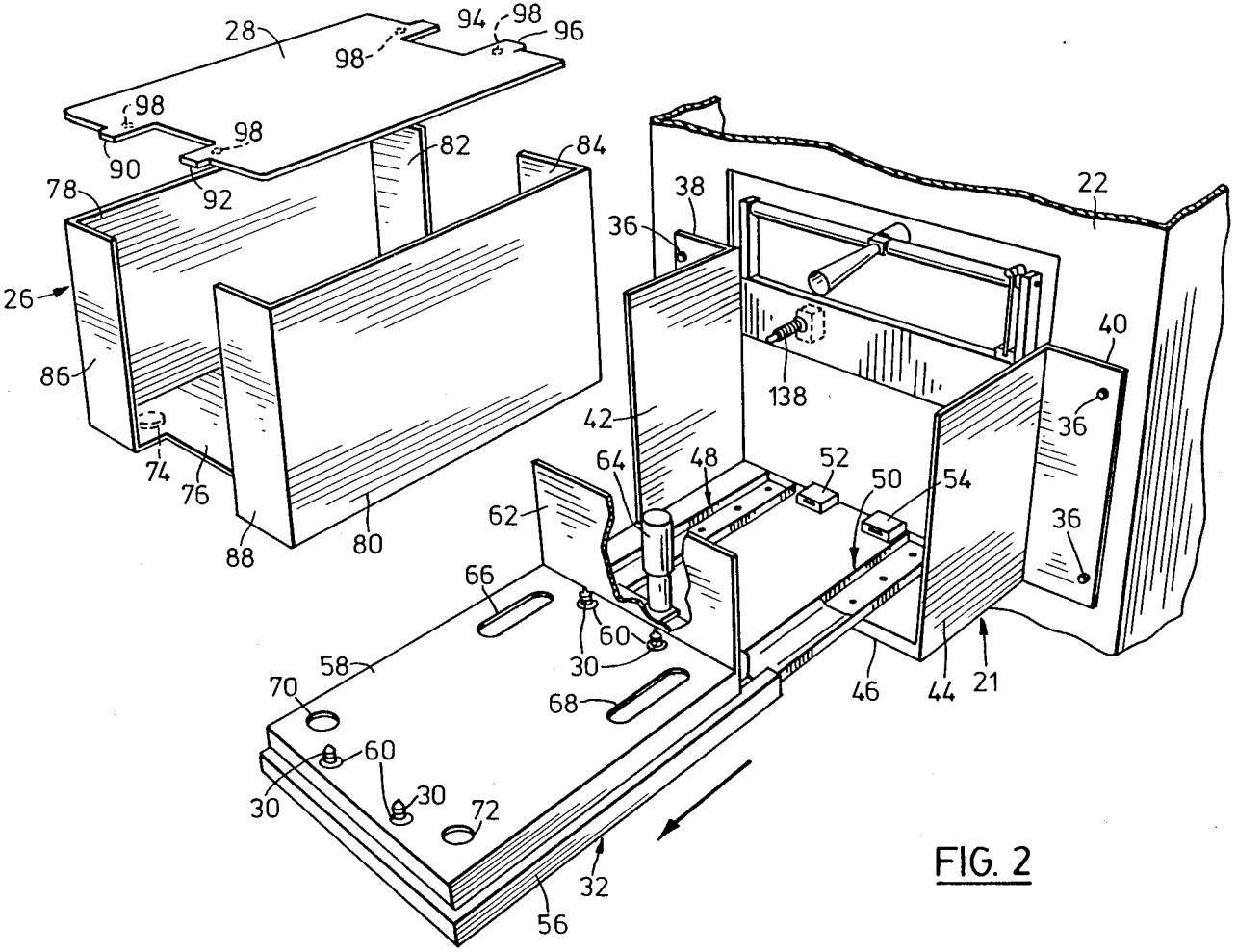
FIG. 2 is a view similar to FIG. 1 and showing individual parts of the paper stacker with the stacker in the unloading position.

Reference is now made to FIG. 2 to describe the major components of the stacker in further detail. The support structure 21 has a pair of flanges 38, 40 attached to the wall by fasteners 36. From these flanges a pair of side walls 42, 44 extend away from the wall 22 and carry a bottom 46 to which is attached fixed parts of runner assemblies 48, 50. The moveable parts of those assemblies are attached to the base 32 so that the base 32 can move on the runner assemblies between an unloading position shown in FIG. 2 and a loading position shown in FIG. 1 where the base 32 is held in place by a pair of magnetic latches 52, 54.

The base 32 is essentially in two parts. Firstly there is a platform 56 which is attached at its underside to the runner assemblies 48, 50 and contains the elevator mechanism as will be described in more detail will reference to FIG. 3. On top of the platform, a hopper carrier 58 is attached and carries bushings 60 for guiding the supports 30 as will also be described with reference to FIG. 3. The hopper carrier 58 is shorter than the bottom 56 and terminates at its inner end in an upwardly projecting wall 62 behind which is a motor 64 attached to the platform 56 for driving the elevator mechanism.

The top surface of the hopper carrier 58 has a pair of parallel slots 66, 68 adjacent the wall 62 and adjacent its forward extremity, a pair of openings 70, 72. The slots and openings are positioned to cooperate with projections such as projection 74 on the bottom of hopper 26 (one of which is shown in broken outline) to position the hopper on the carrier 58. The purpose of the slots is to permit different sizes of hopper to be used with different sizes of paper and to permit location on the carrier 58 while maintaining the outer extremity of the hopper in a constant position.

As also seen in FIG. 2, the hopper 26 has a fixed floor 76 which is recessed at its forward and rearward extremities to provide clearance for the supports 30. At its sides, the fixed floor 76 ends at parallel side walls 78, 80 which in turn terminate at pairs of inner walls 82, 84 and outer walls 86, 88 providing access to the hopper and also defining pairs of parallel edges for guiding the moveable floor 28 by virtue of engagement by pairs of projections outer 90, 92 and inner 94, 96. The moveable floor 28 is a loose fit within the walls of the hopper for unimpeded vertical movement when driven by the supports 30 which, as will be described, move in unison to maintain the floor in a horizontal position. These supports are located beneath the moveable floor in respective depressions 98 which can be seen in broken outline in this view.

Figures 3, 4:
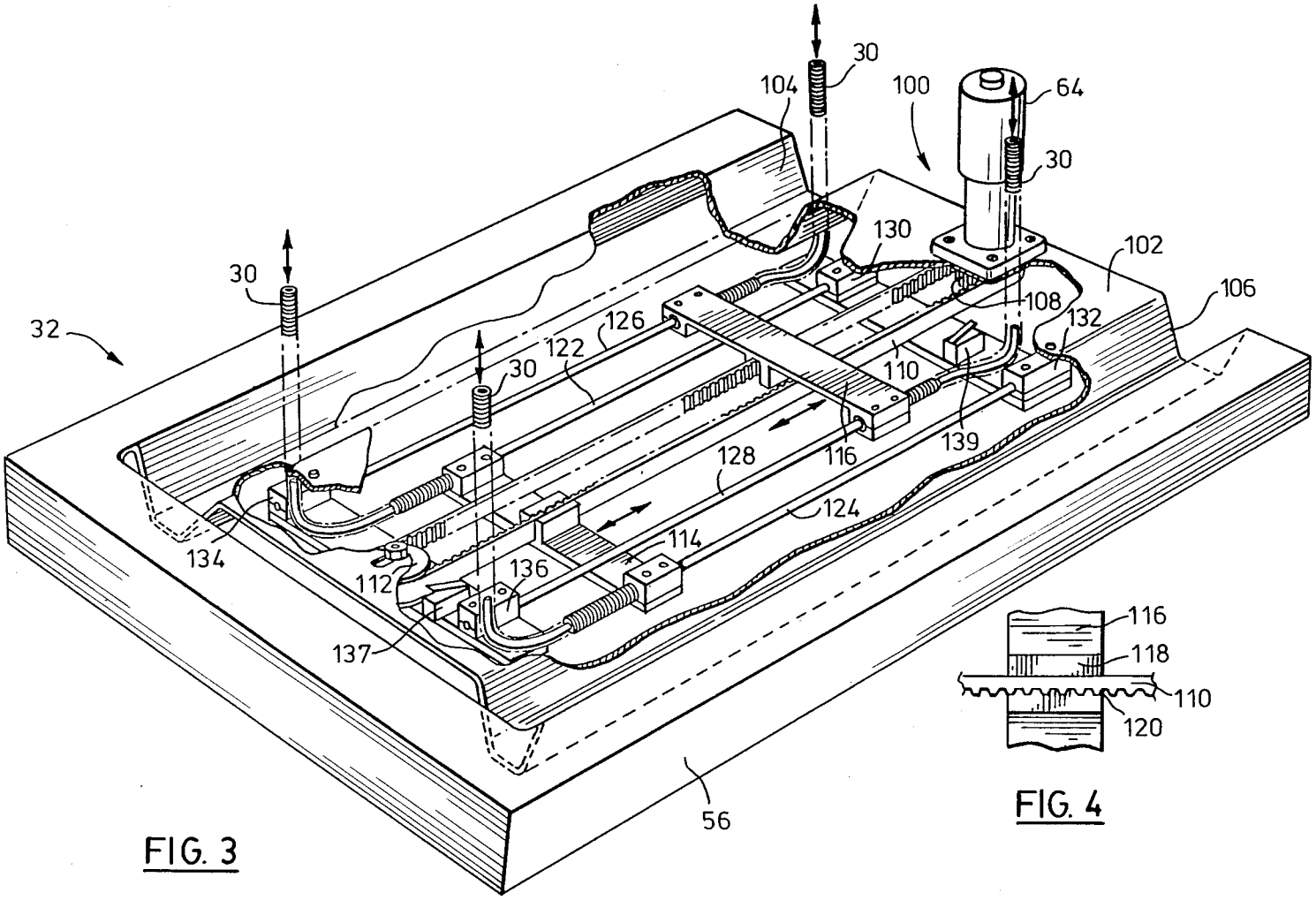
FIG. 3 is a perspective view to a scale larger than that used for FIG. 1 and showing a portion of a base used in the paper stacker and broken away to show an elevator mechanism.
FIG. 4 is a view from below the elevator mechanism to show the engagement of a toothed belt used in the mechanism.

Reference is made next to FIG. 3 which illustrates an elevator mechanism 100 mounted in the platform 56 and including the supports 30 and motor 64. This motor can be activated to drive the supports in unison to both elevate the moveable floor 28 (FIG. 1) and to permit this floor to move downwardly under its own weight. The platform 56 is of sheet metal and includes a central portion 102 bordered by parallel depressions 104, 106 having flat bottoms for attachment at their undersides to the respective parts of the runner assemblies 48, 50 using suitable fasteners (not shown). The motor 64 is mounted at the inner extremity of the central portion 102 and carries a toothed drive wheel 108 under the portion 102 for engagement with a toothed belt 110. This belt is continuous and extends to an idler wheel 112 adjacent the outer extremity of the central portion and the belt 110 is attached to a pair of yokes 114, 116 so that when the motor drives the belt, the yoke 116 moves in a direction opposite to the yoke 114 because the yokes are attached to opposite courses of the belt. The particular attachment is best shown in FIG. 4 which is a view from the underside of one of the yokes and it can be seen that a pair of downwardly extending projections 118, 120 are provided, the projection 112 being shaped to engage with the teeth on the belt 110 supported by a flat wall of the projection 118 to prevent disengagement. Consequently, the yoke moves with the belt.

Returning to FIG. 3, each of the yokes is guided by respective pairs of guide rods 122, 124 and 126, 128. The yokes slide on these rods driven by the belt 110 and engage bottom ends of the supports 30 which are also guided by end portions of the guide rods to move between horizontal and vertical orientation. Outer ends of the guide rods are vertical and extend just beyond the bushings 60 (FIG. 2). Each of the four guide rods is mounted at its inner end at respective support blocks 130, 132, 134, and 136 and at their outer ends the guide rods depend for their location on being within the supports 30 which are located in the bushings 60 of the hopper carrier 58 (FIG. 2).

As a result of the arrangement of the elevator mechanism shown in FIG. 3, when the belt 110 is driven by the motor 64 in a first direction, the yokes 114, 116 will move together, crossing at mid-travel, pushing the supports 30 along the guide rods, through the bushings 60 (FIG. 2) and upwardly to carry the moveable floor 28 (FIG. 1) to a desired height location depending upon the paper sheets it carries as will be described. The movement ends when yoke 114 meets limit switch 137. In the other direction, the yokes will move together, again crossing at mid-travel, until yoke 114 meets limit switch 139 at which point the supports 30 are in the position shown in FIG. 2.

Although the preferred embodiment includes the paper guide mechanism 34, the apparatus described thus far can of course be used to collect paper from the printer or other equipment without the guide mechanism. Such a stacker would include the support structure 21 and base 32 as well as the hopper 26 and its moveable floor 28. The parts are assembled essentially as shown in FIG. 2. The base 32 is in the unloading position and to place the parts ready to receive paper the hopper 80 is positioned with the projections 74 in the respective openings 70, 72 and slots 66, 68 and then the floor 28 is dropped into the stacker so that the upper extremities of the withdrawn supports 30 engage in depressions 98 on the underside of the floor. The base 32 is then pushed toward the printer to move along the runner assemblies 48, 50 and engage with the latches 52, 54 which retain the base in the loading position in use. Also, as the base is moved into the loading position, the end wall 82 of the hopper 26 engages a sensing switch 138 which is used to initiate the raising of the floor and to ensure that the equipment is inoperable unless the hopper is available to receive paper.

Figure 5:
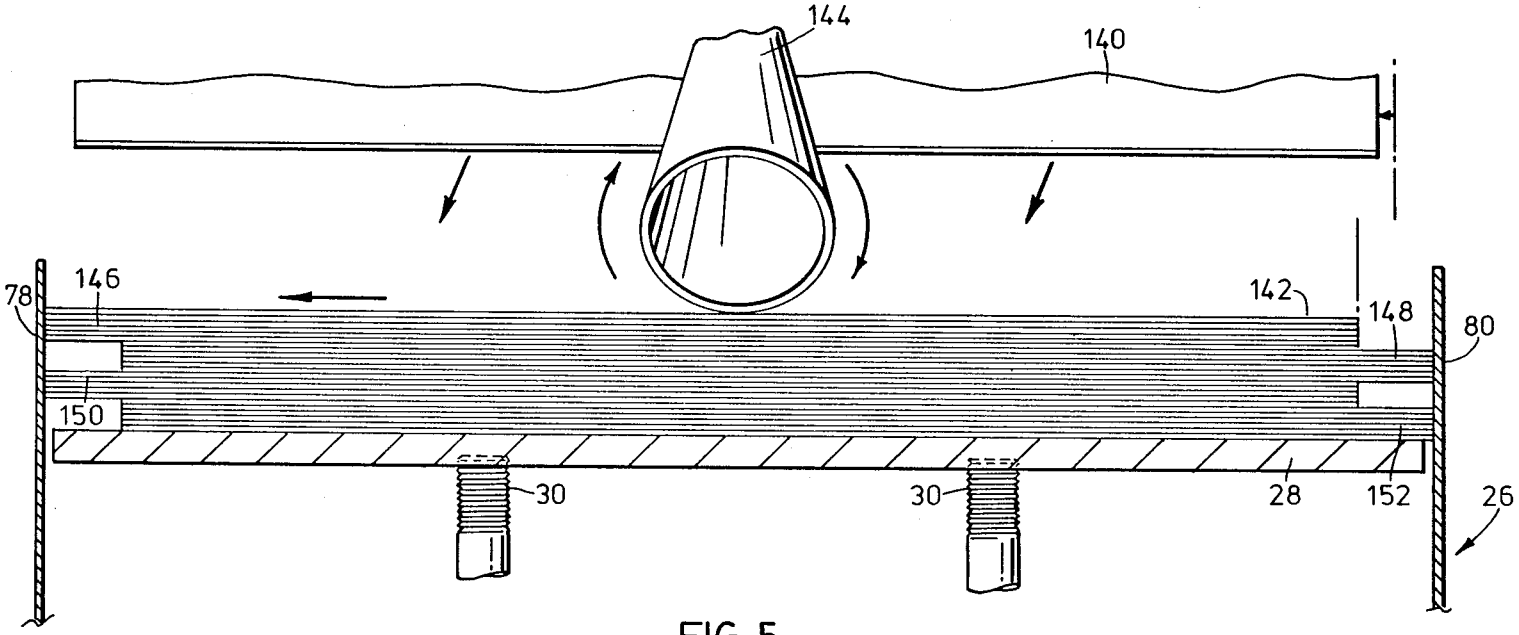
FIG. 5 is a sectional view on line 5—5 of FIG. 1 and drawn to a larger scale to demonstrate the operation of the stacker to pile the paper sheets in discrete groups.
Figure 6:
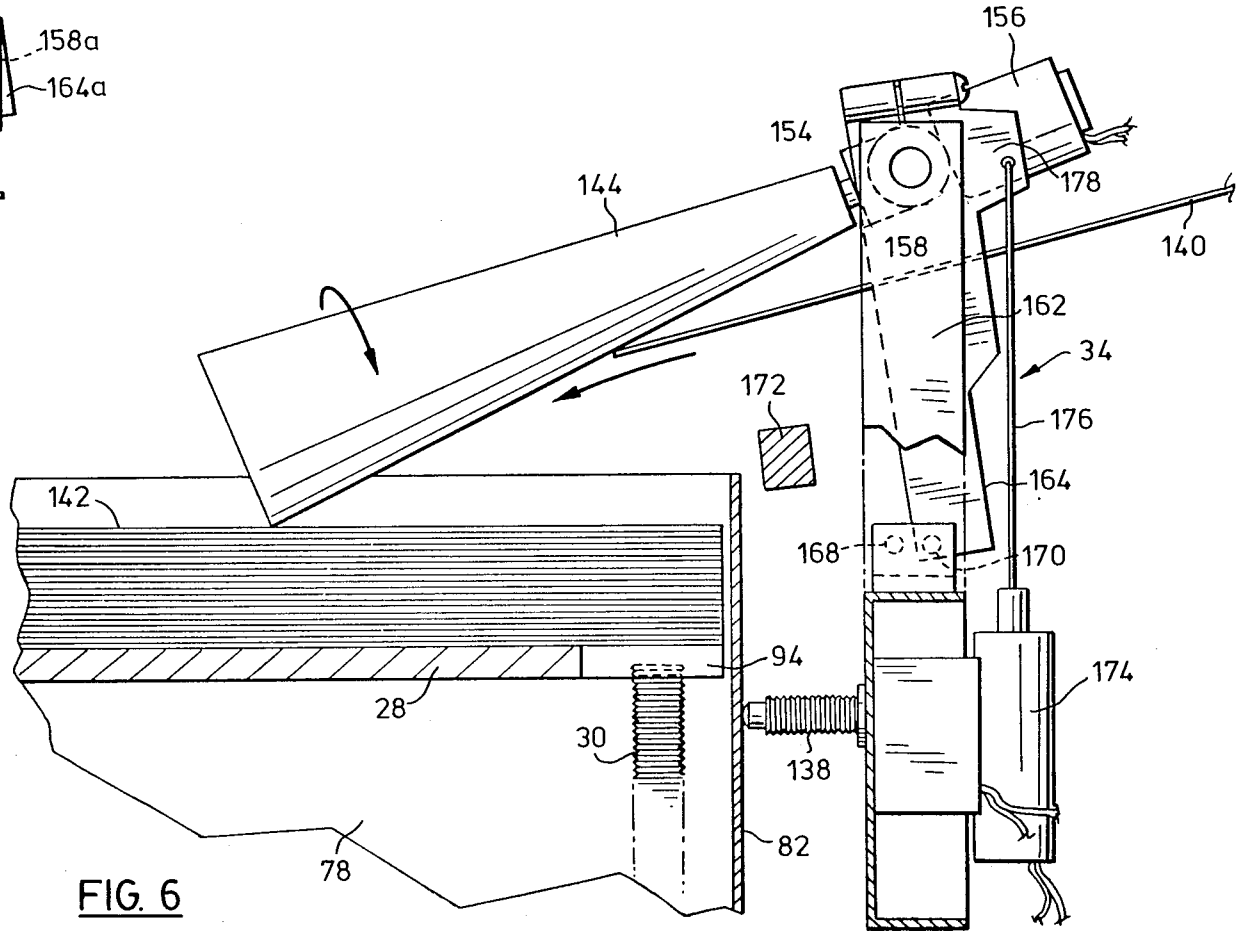
FIG. 6 is a sectional view on line 6—6 of FIG. 1 and drawn to a scale similar to that used for FIG. 5 and showing the operation of a paper positioning device.

Reference is next made to FIGS. 5 and 6 to describe a preferred embodiment of paper guide mechanism 34 used in the preferred embodiment of the stacker. The purpose of the guide mechanism is best illustrated in FIG. 5 where it is seen that the moveable floor 28 is positioned loosely between side walls 78, 80 of the hopper 26 carried by the supports 30. A paper sheet 140 is seen moving towards a stack 142 of such sheets on the moveable floor 28. As the sheet 140 passes under a spinning conical deflector 144 it will be pushed or guided to the left (as drawn) to take a position in a top group 146 in the stack 142. This group differs from the previous group 148 which was positioned against wall 80 by driving the deflector 144 in the opposite direction. Groups 150 and 152 were also located in similar fashion.

It will be evident that by such location of the sheets it will be possible to collate groups of sheets for ready separation after the printer has completed the task of printing the sheets and moving them into the stacker. It will also be evident that the position of the floor 28 is important because if contact between the cone and the paper is not maintained, the offsetting capability of the spinning cone is lost. Also, if it is too low there will be a tendency for the sheet 140 to curl or otherwise fall into the stacker in a position where it is perhaps not collated properly. In the worst situation, paper will be creased or otherwise rendered unacceptable. It is therefore essential that the floor 28 be in the right position to combine with the deflector 124 in moving the sheet into one of the groups. To facilitate this, the mechanism is made sensitive to the position of the stack as will be described with reference to FIG. 6.

The conical deflector 144 is shown in side view in FIG. 6 and it will be seen that it is mounted on a shaft 154 associated with a reversible motor and the assembly is attached centrally to a rotatable element 158 (see also FIG. 1) having its ends journalled in a pair of uprights 160, 162 dependent from the support structure 121.

The rotatable element 158 also carries an adjustable arm 164 which extends downwardly to move in unison with the conical deflector and associated parts about the axis of the element 158. Consequently, as the stack 142 increases in height due to the addition of paper sheets 140, the rotatable element 158 turns clockwise as drawn in FIG. 6 so that the lower end of the arm 164 moves to the left. As best seen in FIG. 1, the upright 162 also supports a generally U-shaped element 166 which provides clearance between its upright limbs to permit passage of the lower extremity of the arm. The relationship between these parts is seen from the side in FIG. 6 which also shows a pair of emitter-sensors 168, 170 associated with the U-shaped element 166. These sensors are typically magnetic or light sensitive so that they each sense when the arm is between the two limbs of the U-shaped member and interrupting the emitter-sensor coupling. In the position shown in FIG. 6, the arm covers sensor 170 and is moving towards the sensor 168 with every sheet 140 entering the stack 142. Each of the sheets 140 may disturb the arm and momentarily cover the sensor 168. However, the sensor 168 will eventually remain covered and at this point the motor 64 (FIG. 4) is actuated to withdraw the supports 30 so that the arm 164 now rotates in an anti-clockwise direction until sensor 168 is uncovered. At this point the motor 64 is stopped and will remain stopped until sufficient paper sheets enter the stack 142 to again cause the arm to rotate to cover both sensors 168, 170. As a result of this, paper entering the stack can never curl or otherwise miss the stack because there is insufficient space for the paper to move anywhere but into the right position.

As also seen in FIG. 6, an anti-static bar 172 is provided above the hopper where the paper will pass it as it falls into the hopper. Also, a solenoid actuator 174 is provided with a rod extension 176 coupled at its end to a projection 178 on the bar 164. The solenoid 174 is connected electrically to the switch 138 so that when there is no hopper present or upon moving the hopper outwardly, the solenoid pulls the rod downwardly thereby rotating the element 158 to carry the conical deflector 144 upwardly out of the hopper to avoid damaging the deflector both as the hopper is removed and when it is replaced. The switch 138 causes the solenoid 174 to be de-energized once the hopper is returned to its loading position so that the deflector 144 again takes up a position shown in FIG. 6.

It will be appreciated that although the preferred embodiment has desirable characteristics which would normally prove beneficial in use, some of the characteristics could be modified within the scope of the invention. For instance, with reference to FIG. 5 it will become evident that the paper sheets could be brought into the hopper to one side of the hopper in a natural flow and be deflected to the other side of the hopper as required. Consequently, sets of paper lying to the left would be in the natural position without any effect from the deflector whereas those to the right would be deflected. The deflector would then work only when necessary to move papers to the right.

Figure 7:
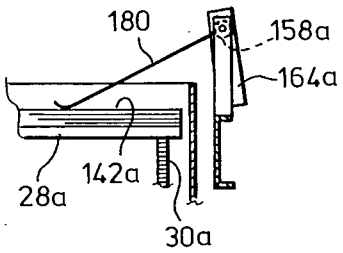
FIG. 7 is a view similar to FIG. 6 and drawn to a smaller scale to demonstrate an alternative embodiment of the invention.

It is also possible to elimate the deflector 144 and use a simple sensor to maintain the moveable floor of the hopper at the required height. Reference is made to FIG. 7 in which it can be seen that a structure corresponding generally to that described with reference to FIG. 6 has an arm **164*a* carried by a rotatable element 158*a* to which is attached a light rod 180 having a curved end resting on the stack of paper 142*a*. The rod moves with the stack to sense the height of the stack and the rest of the structure works in a similar fashion to that described in FIG. 6 so that the moveable floor 28*a*** is adjusted in response to a demand for further space to accommodate more sheets of paper.

Variations can be made within the scope of the invention to control the flow of paper in different ways. For instance, instead of providing staggered groups of paper in the stack, one group can be separated from the next by an insert which is staggered with respect to the rest of the stack. This would separate the stack into groups without having to deflect all of the sheets in a particular group. Also, when using the stacker with a copier, it would be possible to make two sets of copies which are staggered with reference to one another for ready separation upon completion of the copying. These and other modifications can be made within the scope of the invention as described and claimed.

We claim:

1. A paper stacker for use at the output from a sheet printer or copier to collect the sheets, the stacker comprising;

a base;

a hopper supported by the base and having a movable floor which receives the sheets of paper travelling horizontally to build a stack on the floor of the hopper; and an elevator mechanism attached to the base and including four supports of close coiled springs having outer ends in engagement with the moveable floor, means contained in the base to guide portions of the supports inside the base to

2. A paper stacker as claimed in claim 6 and further comprising:

sensor means positioned to sense when the stack of paper building on the floor of the hopper reaches a predetermined level; and drive means responsive to the sensor means to move the elevator mechanism so that the floor moves downwards to make room for more sheets to be fed onto the top of the stack.

3. A paper stacker as claimed in claim 2 in which the sensor means also senses when the floor has moved downwards and in which the drive means is responsive to this further sensing to end the downward movement.

4. A paper stacker as claimed in claim 2 in which the stacker includes paper positioning means operable to deflect selected paper sheets sideways as the sheets enter the stacker to thereby position these sheets in the stack so that the sheets are offset with respect to the other sheets in the stack.

5. A paper stacker as claimed in claim 2 in which the stacker includes paper positioning means operable to deflect selected paper sheets to the left as the sheets enter the stacker and to deflect the remaining sheets to the right to thereby position the sheets in the stack so that the selected sheets are offset with respect to the other sheets in the stack.

6. An elevator mechanism for use to support and vary the height of a moveable floor which is to support paper sheets received from a printer or copier, the elevator mechanism comprising:

a base having a top surface defining four openings;

four close-coiled spring supports located in the openings and having upright portions above the openings, terminating an outer ends for engagement under the floor, bent portions immediately below the openings, and horizontal portions contained in the base and terminating at inner ends, the bent portions forming transitions between the respective horizontal and upright portions of the supports; and drive means attached to the base and in engagement with the supports at said inner ends and operable to push the supports outwardly to increase the lengths of the upright portions, and to pull the supports to decrease the lengths of the supports whereby the elevation of the floor can be changed.

7. An elevator mechanism as claimed in claim 6 in which the drive means comprises:

motor means;

a continuous element drivably connected to the motor means and supported by the base, the element having parallel first and second courses which move in opposite directions when the motor means is actuated;

a pair of yokes each attached to a respective pair of the supports at said inner ends of these supports and to one of said courses to move the yokes and hence the supports to cause said change in elevation of the floor.

8. An elevator mechanism as claimed in claim 7 in which the continuous element is a toothed belt.

9. A paper guide mechanism for use in deflecting selected paper sheets sideways as they travel into a hopper to build up a stack of paper sheets in which the selected sheets are staggered with reference to the remaining sheets, the mechanism comprising:

a deflector rotatable about a first axis;

drive means operable to rotate the deflector; and suspension means supporting the deflector about a second axis at right angles to said first axis with the deflector biassed to fall downwards about the second axis to engage the paper sheets so that in operation the deflector drives the selected sheets as they engage the deflector as they travel into the hopper.

10. A paper guide mechanism as claimed in claim 9 in which the deflector is conical and in which said first axis is the axis of generation of the conical deflector, the deflector being largest in diameter farthest away from the suspension means.

11. A paper stacker for use at the output from a sheet printer or copier to collect the sheets, the stacker comprising:

a base an elevator mechanism attached to the base;

a hopper supported by the base and having a movable floor which receives the sheets of paper travelling horizontally to build a stack on the floor of the hopper, the floor being supported by the elevator mechanism for movement vertically in the hopper between upper and lower positions;

sensor means positioned to sense when the stack of paper building on the floor of the hopper reaches a predetermined level; and drive means responsive to the sensor means to move the elevator mechanism so that the floor moves downwards to make room for more sheets to be fed onto the top of the stack, the elevator mechanism comprising four retractable supports of close coiled springs, each of the springs having an upright portion exposed above the base and terminating in supporting contact with the moveable floor, a bent portion forming a transition from vertical to horizontal, and a horizontal portion contained in the base; guide means in the base maintaining the horizontal portions in position and bends in said bent portions; and moving means contained in the base and in engagement with inner ends of the springs to move the supports horizontally inside the base thereby changing the height of the moveable floor.

* * * * *